US005752670A

United States Patent [19]

Lasecki et al.

[11] Patent Number: 5,752,670

[45] Date of Patent: May 19, 1998

[54] WIRE DISPENSER WITH RETRACTOR

[76] Inventors: Marie Ricca Lasecki, 2596 Front St., Slidell, La. 70458; David S. Bercegeay, P.O. Box 52443, Lafayette, La. 70505

[21] Appl. No.: 832,076

[22] Filed: Apr. 2, 1997

[51] Int. Cl.[6] ..... B65H 23/04

[52] U.S. Cl. ..... 242/381; 242/416; 242/546

[58] Field of Search ..... 242/381, 410, 242/416, 420, 421.8, 546, 597.4

[56] References Cited

U.S. PATENT DOCUMENTS

| | | | |
|---|---|---|---|
| 3,044,724 | 7/1962 | Goodwin | 242/546 |
| 3,531,057 | 9/1970 | Way | 242/410 |
| 3,974,974 | 8/1976 | Nishikawa | 242/546 |
| 4,473,197 | 9/1984 | Yach . | |
| 4,842,215 | 6/1989 | Takami | 242/546 |
| 5,076,510 | 12/1991 | Norlander | 242/381 |
| 5,316,232 | 5/1994 | Lambert, Jr. . | |

*Primary Examiner*—John M. Jillions
*Attorney, Agent, or Firm*—Robert N. Montgomery

[57] ABSTRACT

A coiled material dispenser with automatic spring retractor for respooling wire and the like after a portion of the material has been removed. The dispenser being capable of adaptably receiving different size spools is suspended at or near a work station where a portion of such material is required to be despooled and removed for use. The spring rewinder automatically retracts at least a portion of the excess material back onto the spool. A brake arm allows the respooling of the material to be stopped at any point by simply releasing tension on the material.

18 Claims, 6 Drawing Sheets

WIRE DISPENSER WITH RETRACTOR

BACKGROUND OF THE INVENTION

1. Field of Invention

This invention relates to devices used in the dispensing of spooled material such as light gage wire and the like and more particular to the despooling and automatic, controlled respooling of excess material after a portion of the material has been removed. It is anticipated that other spooled materials, such as rope, ribbons, etc., may also be dispensed by use of this device.

2. Background of the Invention

In some fields, it is necessary to dispense a length of an appropriate size and type of wire, generally of a small diameter such as 18 through 6 gauge, for attaching to and the hanging of a picture frame. A variety of different sizes and types of spools are used for such wire; most are usually provided with a hollow hub for mounting on a spindle of some type, which may also vary in diameter and width. Such spools are usually suspended, on a common spindle, near one end of the workbench. The craftsman often measures such wire by simply extending the selected wire across the workbench, making appropriate allowance for routing, and cutting the length from the reel. The wire is then released and allowed to run free due to the resiliency of the spooled wire, thus tangling the wire with adjacent spool wires or leaving unsightly tangles dangling from the spool. Such entanglements result in a messy work space and loss of production time for the framer. Additional time is lost when changing reels. Since such reels are usually mounted on a common spindle, it is necessary to remove all spools to replace one empty reel. Therefore, all despooled wire must be respooled and secured before removing each reel from the spindle.

Other applications include electrical panel hook-up application when such panels are wired at a work bench. Reels of different size wire in several colors are often located adjacent to the bench thus producing the same problem as indicated above.

Various types of respoolers have been used which provide drag to prevent override and which use electric motors for respooling. See U.S. Pat. No. 5,316,232 and 4,473,197, as well as other reel to reel respoolers and large cable and sheet metal reel winding machines. Electric cable and hose retractors have also been developed which allow for the pay-out and retraction of a fixed length of cable, hose, etc. However, such devices are not applicable when a length of the paid-out material is cut from the spool. Automatic rewinding devices are inherently expensive and cost prohibitive for small spool applications such as those discussed herein.

A means is therefore needed which will allow each spool to dispense a length of wire, ribbon, twine or the like without back lashing and without excessive wire, etc. being left in a manner where it may become tangled with wire, etc. from adjacent spools. An inexpensive means of automatically rewinding the excess wire at each spool is further required as is the need to replace each spool independently without disturbing the adjacent spools.

SUMMARY OF THE INVENTION

It is the objective of the present wire dispenser apparatus to provide a relatively inexpensive wire dispenser having pretensioning and retraction capability. Said objective includes simultaneous dispensing and automatic, controlled respooling of wire or the like for individual spools.

The invention includes a drum housing having an internal rotor assembly, rewind spring assembly and friction brake assembly and further includes a guide loop, spindle assembly with tensioning springs, a compression plate and a pair of friction disks. A variety of material spools and sizes may be mounted on the dispenser by removing a compression nut from one end of the spindle assembly and loading the spool onto the spindle between the two friction disks, reinstalling the jam nut, adjusting the spindle assembly to the spool size, and tensioning the friction plates so that the reel may be turned relative to the friction plates but not allowed to run free. The free end of the material being dispensed from the spool is then fed through the brake guide loop. Applying tension to the material being dispensed from the spool against the guide loop releases the brake assembly thus allowing the rotary assembly and spring assembly to turn, thereby winding the coil spring as material is being paid-out. Once the rotary spring is fully wound, the spool is allowed to continue despooling by overriding the friction disk, thus allowing an infinite amount of material to be despooled. Releasing the tension on the material at the guide loop, at any time, resets the brake thus allowing the spooled material to remain extended. Once a length of spooled material has been removed from the paid-out material, application of tension on material provides pressure against the guide loop, thus releasing the brake and allowing the rotary spring to uncoil, thus respooling any excess material back onto the spool. Again, releasing the tension on the wire allows the brake to reset, thus stopping the respooling process. The dispenser may be mounted vertically or horizontally by simply retaining a shoulder portion of the drum assembly. Therefore, any number of spools may be mounted on a frame in manner whereby each spool can be removed independently of the others.

Various size spindle sleeves may also be provided for adaptation of various spool spindle sizes, thus allowing a wide range of spools to be used with the dispenser. The rotary coil spring may also be sized to accommodate particular applications depending on the average length and weight of the material being dispensed.

The related objectives and advantages of this invention are graphically apparent by the following drawings and related detail description. Both the drawings and description are for illustrative purposes.

BRIEF DESCRIPTION OF THE DRAWINGS

For a further understanding of the nature and objects of the present invention reference should be made to the following detailed description, taken in conjunction with the accompanying drawings, in which like parts are given like references numbers, and wherein.

DESCRIPTION OF THE PREFERRED EMBODIMENT

Figure 1:
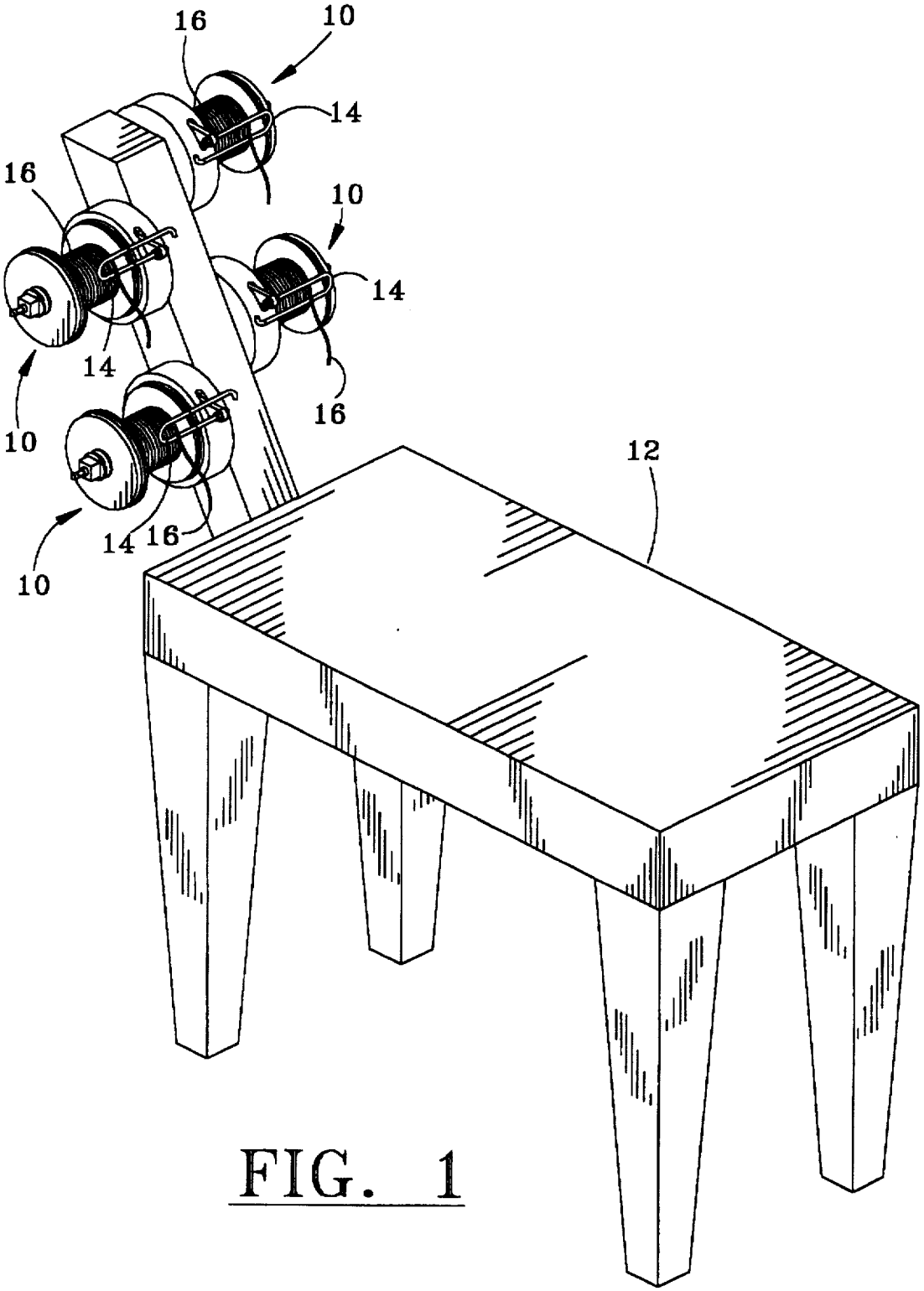
FIG. 1 is an isometric view of a typical workbench with spooled material dispensers in the horizontal position.
Figure 2:
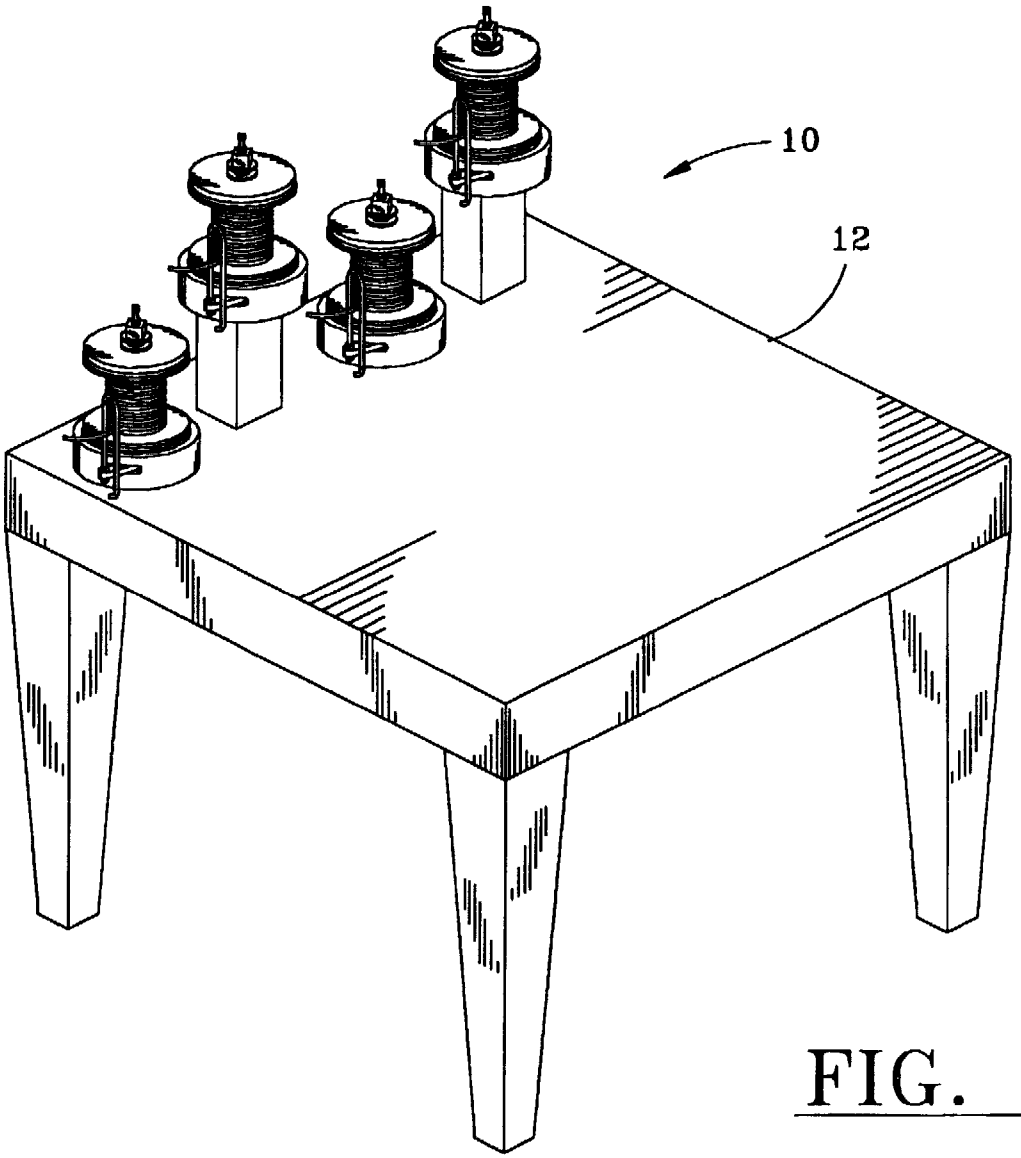
FIG. 2 is an isometric view of a typical workbench with spooled material dispensers in the vertical position.
Figure 3:
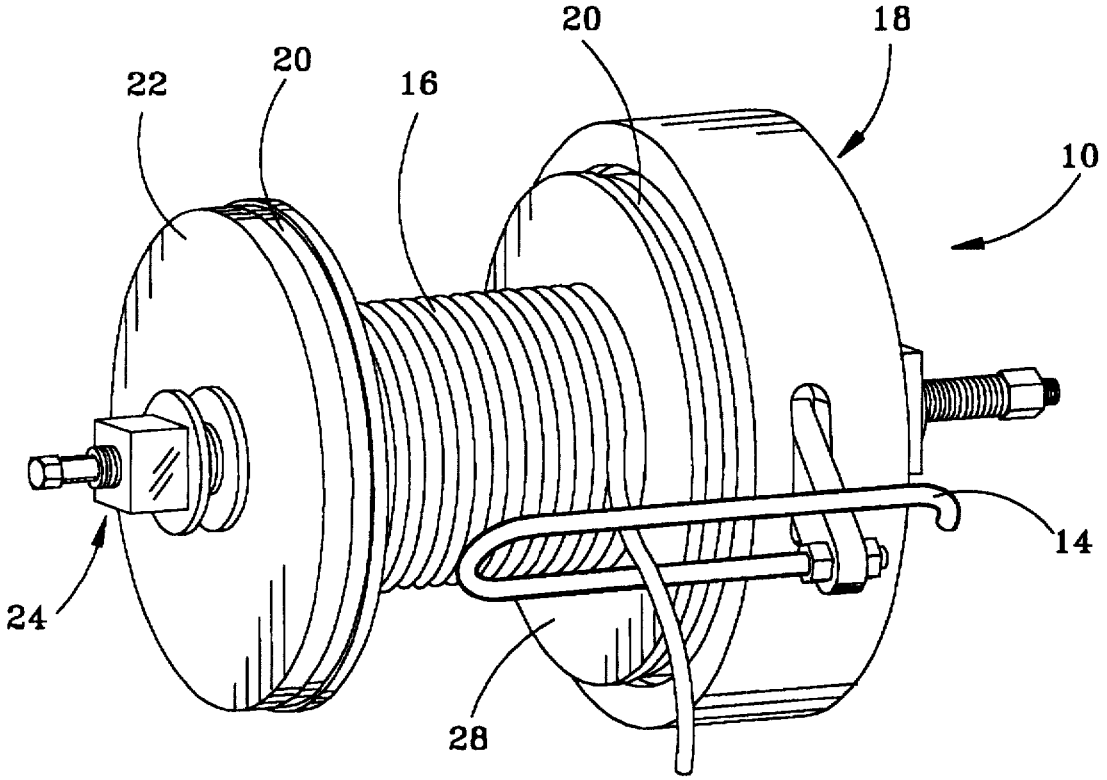
FIG. 3 is a front and left side isometric view of the dispenser.
Figure 4:
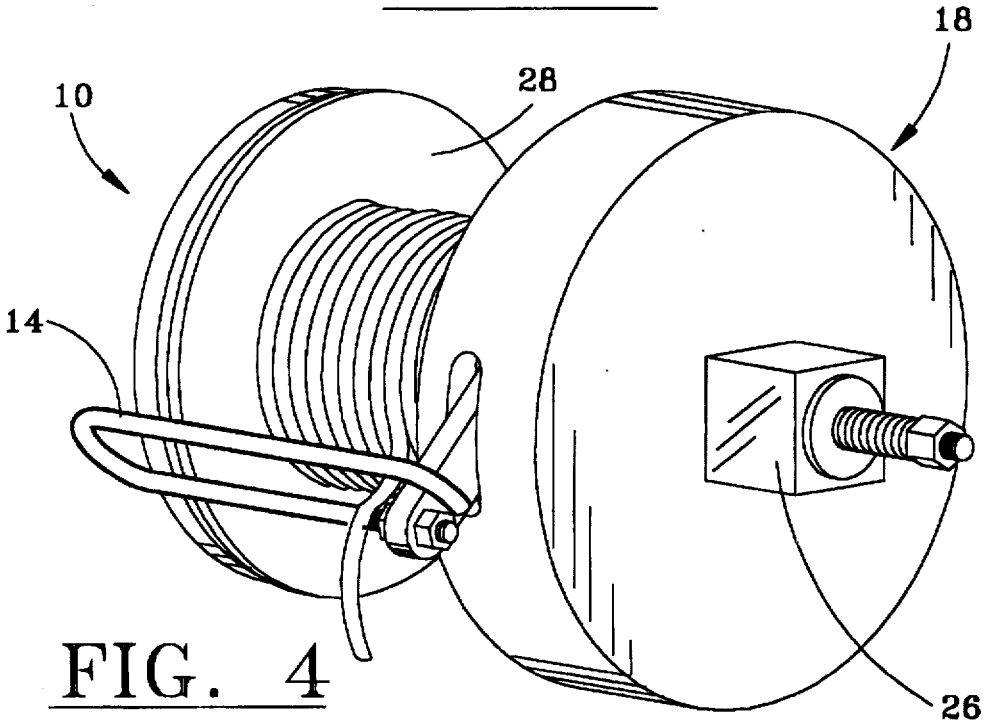
FIG. 4 is a front and right side isometric view of the dispenser.
Figure 5:
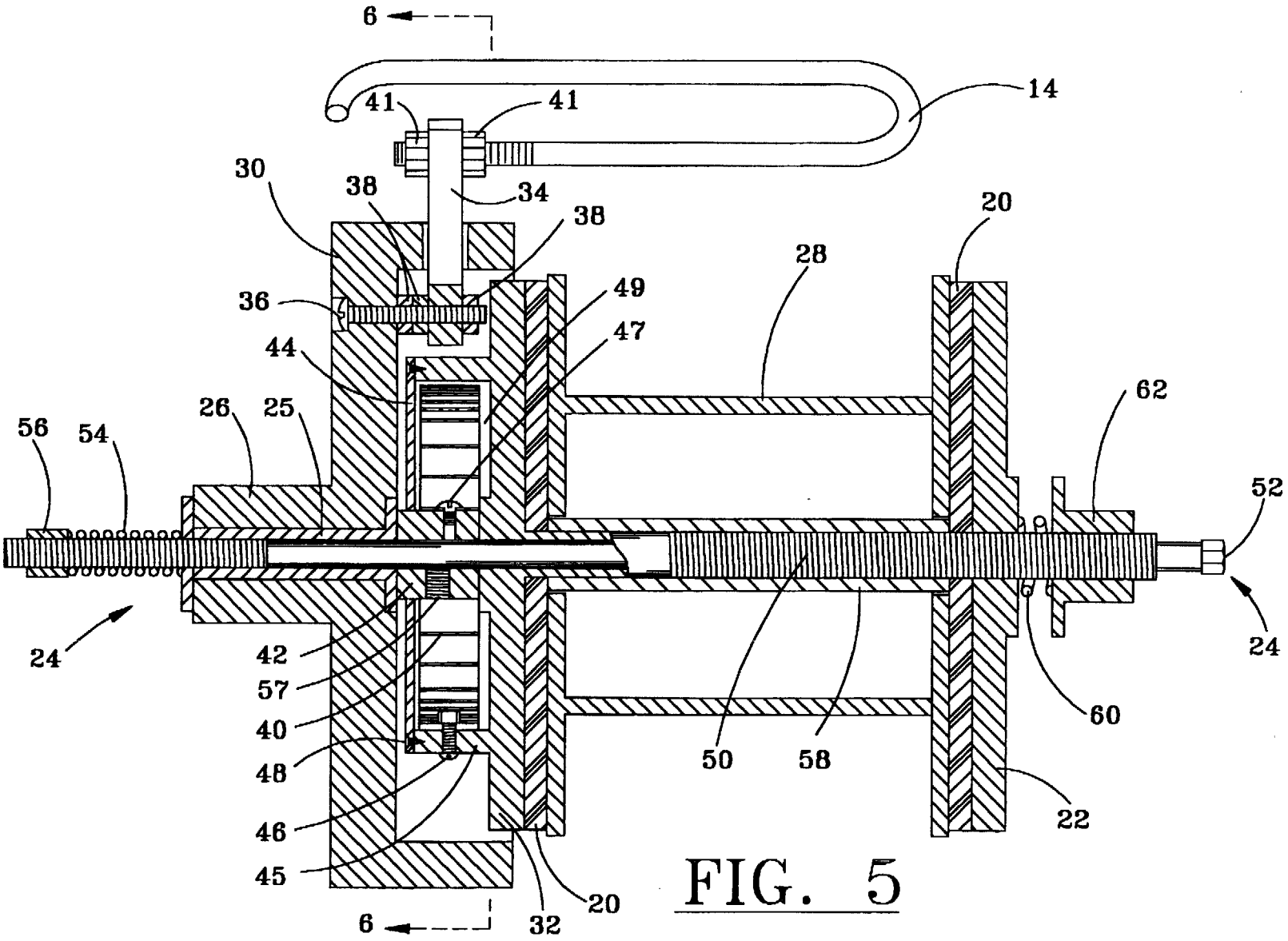
FIG. 5 is a front elevation cross section view of dispenser.
Figure 6:
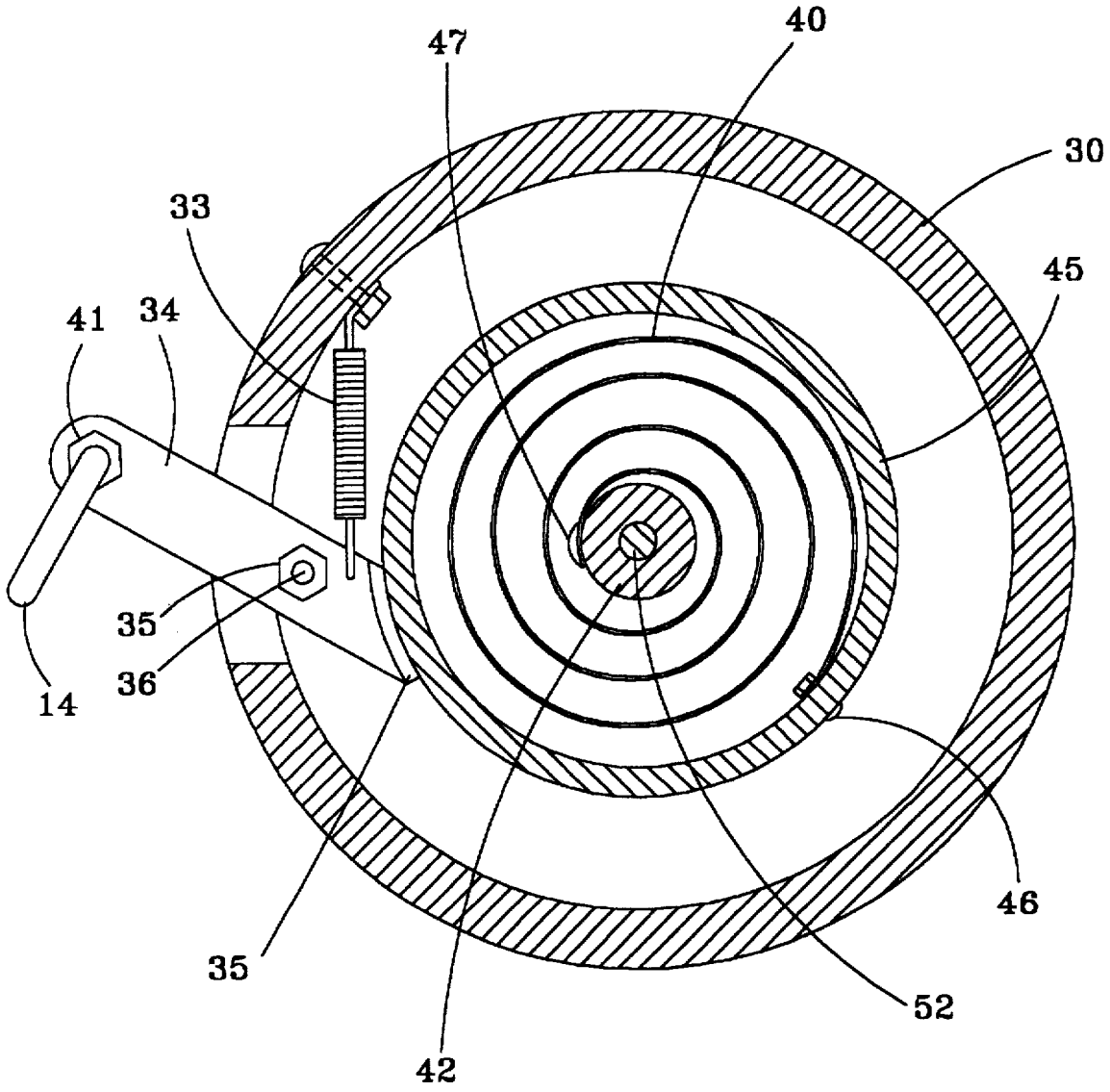
FIG. 6 is a cross section view taken along sight line 5—5 seen in FIG. 5.
Figure 7:
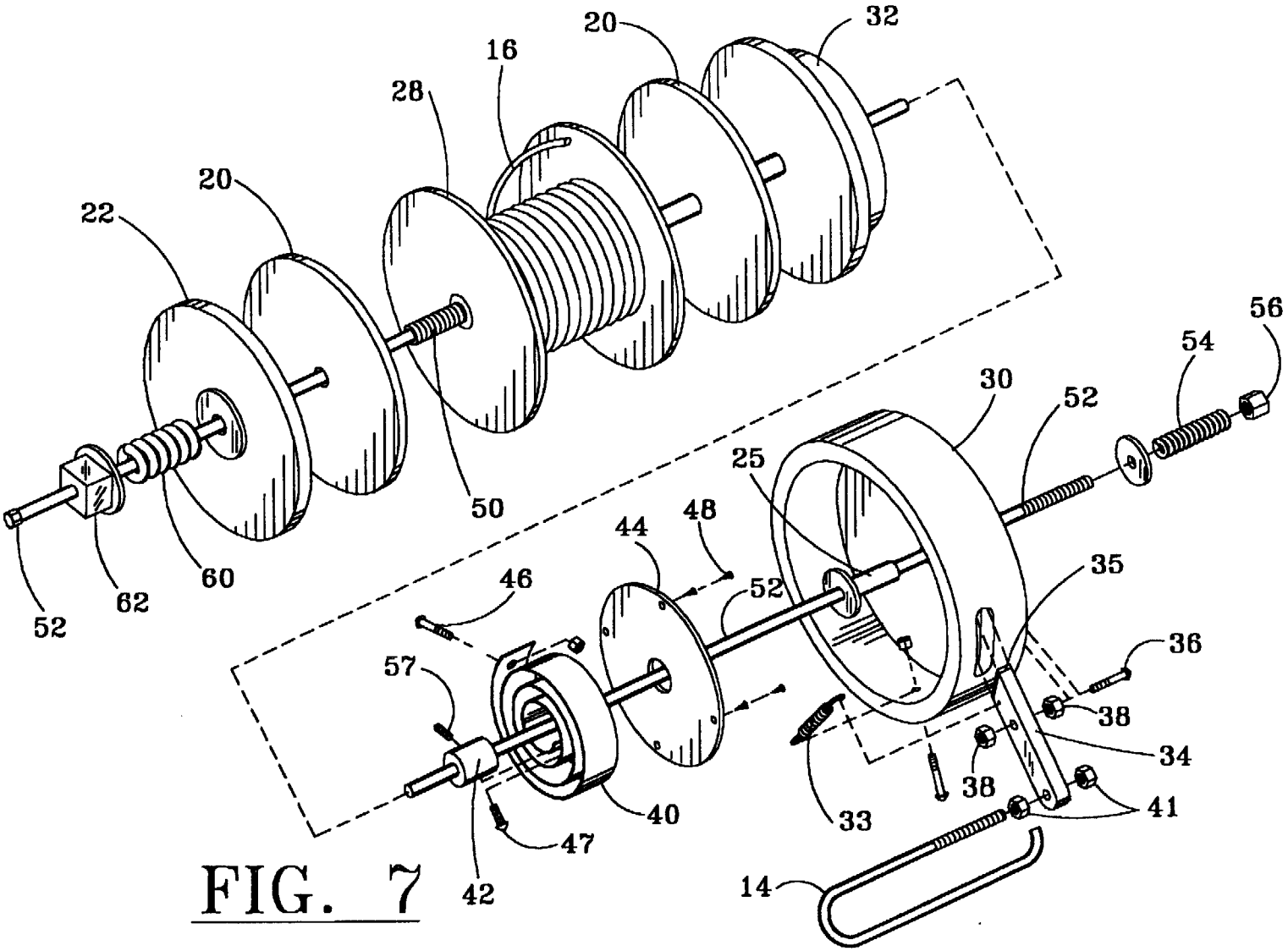
FIG. 7 is an exploded isometric view of the dispenser.

The spooled material dispenser 10 assembly first shown in FIG. 1 may be mounted in any convenient manner adjacent to or on a workbench 12 as illustrated in FIG. 1 & 2. The dispenser assembly 10 may be mounted horizontal as shown or vertical in a staggered or parallel manner as seen in FIG. 2 to conserve space between the spools provided, that the guide loop 14 will be deflected when the wire 16 is being despooled. Turning next to FIG. 3 we see the dispenser assembly 10 includes a drum housing assembly 18, a pair of friction disks 20, a compression plate 22 and a spindle assembly 24. FIG. 4 illustrates a block portion 26 of the drum housing assembly 18 that serves as the mounting and retaining member for the dispenser assembly 10. This block portion 26 prevents the drum housing 18 from rotating and further serves to support the spindle assembly 24 seen in FIG. 5 about which the wire reel or spool 28 rotates. As also seen in cross section FIG. 5 the drum housing assembly 18 may be constructed of any suitable material, including polymeric types, and comprises an outer stationary drum portion 30, and a rotary stator 32. The outer or stationary drum portion 30 of the drum assembly 18 further comprises a pivotal brake arm 34 to which is attached a guide loop 14 that is adjustable via jam nuts 41. The brake arm 34 is pivotally mounted from a bolt 36 and secured with nuts 38. The brake arm 34 is held in frictional contact with the stator drum 45 by a spring 33 seen in FIG. 6. A brake lining material 35 is added to the foot or contact point of the brake arm 34. The drum housing 30 is also fitted with a metal sleeve 25 inserted along its central axis. The rotary stator 32 may also be a polymeric type material and is configured with the external drum portion 45, an internal cylindrical portion 49 and a hollow threaded stem portion 50. The rotary stator 32 further comprises an internal coil spring 40, located within the internal cylindrical portion 49, one end of which is attached to a central hub 42 by screw 47 with the other end attached to the inside diameter of the rotary stator 32 by screw 46. The coil spring 40 is contained within the rotary stator 32 internal cylindrical portion 49 by a cover plate 44 attached to the stator 32 with screws 48. The drum portion 30 and the stator 32 are held in axial alignment by a spindle 52 extending through the drum housing's metal sleeve 25, through the central hub 42 and through the hollow stem 50. The spindle 52 passing though the entire assembly 10 is held in lateral alignment by the set screw 57 located in the rotary central hub 42 and in frictional contact with the drum assembly 18 by a compression spring 54 and adjustment nut 56. Adjustment of the nut 56 increases tension between the stationary drum portion 30, the rotary stator and central hub 42, thereby providing a secondary clutch operation. The central hub 42 is secured to the spindle 52 by the set screw 57 thus securing one end of the coil spring 40 to the spindle 52 thereby allowing rotor rotation about the spindle 52 to wind the coil spring 40. The wire reel or spool 28 is held in rotatable frictional contact about the hollow stem 50 by polymeric friction disk 20 located at each end of the spool. In some cases it may be necessary to insert a sleeve 58 through the central core of a spool to compensate for oversize spool core diameters. The compression plate 22 is slideable upon the hollow stem 50 and serves to retain the friction disk 20 and the spool 28 on the hollow stem 50. A compression spring 60 is provided for compression by a nut 62 threaded upon the hollow stem 50 for maintaining tension on the friction disk 20.

The compression nut 62 is normally set to provide sufficient friction to the reel 28 relative to the stator 32 to insure that the coil spring 40 is wound by revolving the spool 28. However, the reel or spool 28 is allowed to turn upon the hollow shaft 50 when the force exerted upon the reel 28 by the wire 16 being dispensed exceeds the compression applied against the friction plate 22 by the compression nut 62. The brake arm 34 is held in sliding contact with the stator drum 45 at all times by spring 33 allowing the stator 32 to turn in only one direction. Any attempt by the stator to reverse direction causes the brake arm 34 to apply counter force, thus preventing stator rotation. Once the coil spring 40 is fully wound and the brake arm 34 is automatically set, the brake arm 34 must be manually released to allow counter rotation of the stator 32. Therefore, the reel 28 in frictional contact with the stator 32 rewinds the wire 16 at least to the extent the coil spring has been wound by simply tugging on the wire 16 being dispensed, thus exerting a force on the wire guide 14 which releases the brake arm 34, allowing the stator 32 to counter rotate. Such counter-rotation may be stopped at any time by allowing the brake arm 34 to reset. When wire is paid out from the spool 28 and some portion of the wire 16 is removed, it becomes essential that the coil spring 40 not be fully wound each time. Therefore, a secondary clutch or friction release operation is provided by adjustment of the tension applied by the spindle compression spring 54. This double clutch action allows the wire 16 to be dispensed from the spool 28 in an easy manner without fully winding the coil spring 40 each time. The spindle assembly is of sufficient length to allow for a variety of spool widths and can be easily adjusted to accommodate a variety of sizes by simply relocating the set screw 57 along the spindle 52 and retensioning the compression spring 54 via the adjusting nut 56. The present invention thus provides a simple and efficient means for automatically rewinding light gauge wire and other materials on a spool. Various modes of executing the invention are contemplated as being within the scope of the following claims distinctly claiming the subject matter taught herein which is considered as invention.

What is claimed is:

1. A spooled material dispensing apparatus with spring rewind comprising:

a) a spindle; at least a portion of which is treaded and having a multifaceted head at one end;

b) a spring rewinder having a drum housing assembly rotatable relative to said spindle and a rotary assembly said rotary assembly cooperative with said drum housing assembly and rotatable about said spindle;

c) a spool rotatable relative to and in frictional engagement with said rotary assembly;

d) an adjustment means for controlling frictional engagement between said stationary drum housing assembly and said spindler; and e) an adjustment means for controlling frictional engagement between said spool and said rotary assembly.

2. A spooled material dispensing apparatus with spring rewind according to claim 1 wherein said rewinder drum housing assembly comprises:

a) a drum defined by a raised side wall having a slot therein and a bottom portion having an interior and exterior side said, exterior side having a raised block portion, and a central bore extending through said bottom and said block portion;

b) a pivot pin located within said interior adjacent said slot;

c) a brake arm pivotally attached to said pivot pin extending through said slot;

d) a guide arm adjustably attached to said brake arm; and e) a biasing means attached to said brake arm and said drum.

3. A spooled material dispensing apparatus with spring rewind according to claim 2 wherein said rewinder rotary assembly further comprises;

a) a stator, rotatable relative said drum housing assembly comprising a hollow, central stem portion located on one face of said stator, and a drum portion located on a face opposite said stem portion;

b) a coil spring located within said drum portion one end of which is attached to said drum portion;

c) a hub member located within said drum portion in frictional contact with said stator portion and said drum housing assembly, adjustably attached to said spindle and secured to another end of said coil spring; and d) a cover plate attached to said drum thereby containing said coil spring.

4. A spooled material dispensing apparatus with spring rewind according to claim 1 wherein said adjustment means for controlling frictional engagement between said drum housing assembly and said spindle further comprises a threaded nut engaging said threaded spindle and a biasing means slideable along said spindle.

5. A spooled material dispensing apparatus with spring rewind according to claim 1 wherein said adjustment means for controlling frictional engagement between said spool and said rotary assemble further comprises at least one friction disk and a compression plate located adjacent said spool, slideable along said spindle, a threaded nut engaging said threaded portion of said spindle and a biasing means slideable along said spindle.

6. A spooled material dispensing apparatus with spring rewind according to claim 2 wherein said block portion is a means for supporting and retaining said drum assembly in a stationary manner.

7. A spooled material dispensing apparatus with spring rewind according to claim 2 wherein said brake arm further comprises fiction gripping material at point of contact with said rotary assembly.

8. A spooled material dispensing apparatus with spring rewind comprising:

a) a spindle assembly comprising a rod having a head portion and a threaded portion, a compression plate slideable upon said rod and a nut in threadable engagement with said threaded portion:

b) a drum assembly rotatable about said spindle assembly comprising;

i) a drum portion;

ii) a brake arm pivotally attached to said drum portion; and iii) a guide loop attached to said brake arm c) a rotary assembly having an externally threaded, hollow stem portion extending therefrom, rotatable about said spindle assembly, in frictional contact with a central hub attached to said spindle assembly, said rotary assembly further comprising a cylindrical drum portion having a coil spring located therein, said coil spring attached to said cylindrical drum and to said central hub, said hub being adjustably attached to said spindle assembly and held in frictional engagement with said drum assembly and said rotary assembly;

d) at least one friction disk and a compression plate having a central bore therein slidably located upon said threaded hollow stem portion of said rotary assembly; and e) a compression spring compressible by an adjustable nut in threadable engagement with said threaded hollow stem portion.

9. A spooled material dispensing apparatus with spring rewind according to claim 8 wherein said drum portion further comprises a mounting means for supporting and retaining said drum assembly.

10. A spooled material dispensing apparatus with spring rewind according to claim 9 wherein said brake arm further comprises friction gripping material rotary.

11. A spooled material dispensing apparatus with spring rewind according to claim 8 wherein said apparatus further comprises a spool rotatable about its central axis upon said hollow stem portion of said rotary assembly and held in frictional compression with said rotary assembly, adjacent said friction disk by said compression plate, spring and tension adjustment nut.

12. A method for rewinding excess material on a spool after dispensing and removing a portion of said spooled material comprising the steps of:

a) loading a spool of material to be dispensed onto an apparatus comprising:

i) a spring rewind means in frictional engagement with said spool for rewinding said spool as result of having placed said spring rewind means in tension by dispensing material from said spool;

ii) a means for adjusting said frictional engagement with said spool to allow said spool to continue to dispense material when said spring rewind means is at maximum tension;

iii) a drum housing in frictional engagement with said spring rewind means;

iv) a means for adjusting said frictional engagement between said drum housing and said spring rewind means to control tensioning of said spring rewind means; and v) a brake arm having a guide loop adjustable attached thereto, pivotally attached to said drum housing in frictional contact with said spring rewind means;

b) setting said frictional engagement means with said spool in a manner whereby when said spool is rotated as a result of paying out spooled material, a portion of said rewind means is also rotated;

c) setting said means for adjusting said frictional engagement between said drum housing and said spring rewind means to allow said spring rewind means to override said preset tension; and d) threading the free end of the spooled material to be dispensed through said guide loop.

13. A method for rewinding excess material on a spool after dispensing a portion of said spooled material according to claim 12 wherein said method further comprises the step of drawing said material through said guide loop in a manner whereby said material applies pressure to said guide loop thus releasing frictional contact with said spring rewind means.

14. A method for rewinding excess material on a spool after dispensing a portion of said spooled material according to claim 13 wherein said method further comprises the step of rotating said spool when paying out material thereby winding a coil spring inside said rewind means until a preset tension on said frictional engagement means with said spool is reached, at which time said spool is allowed to override frictional engagement with said rewind means.

15. A method for rewinding excess material on a spool after dispensing a portion of said spooled material according to claim 14 wherein said method further comprises the step of releasing pressure on said guide loop to restore frictional engagement between said brake arm and said rewind means thus preventing said rewind means from returning to a static condition when held in tension by said coil spring.

16. A method for rewinding excess material on a spool after dispensing a portion of said spooled material according to claim 15 wherein said method further comprises the step of removing said spool without disturbing said rewind means.

17. A method for rewinding excess material on a spool after dispensing a portion of said spooled material according to claim 15 wherein said method further comprises the step of allowing a variety of spool sizes to be adapted to said rewind means.

18. A method for rewinding excess material on a spool after dispensing a portion of said spooled material according to claim 15 wherein said method further comprises the step of retaining a portion of said rewind means in a stationary manner.

* * * * *